United States Patent [19]

Le Gal

[11] 4,208,037

[45] Jun. 17, 1980

[54] PLAYPEN

[76] Inventor: André A. Le Gal, La Rive 47110, Ste Livrade sur Lot, France

[21] Appl. No.: 3,779

[22] Filed: Jan. 15, 1979

[30] Foreign Application Priority Data

Jan. 17, 1978 [FR] France ..... 78 01168

[51] Int. Cl.[2] ..... E04H 17/18

[52] U.S. Cl. ..... 256/25; 5/99 C; 119/20; 273/3; 403/223; 403/85

[58] Field of Search ..... 256/25, 26; 5/99 R, 5/99 A, 99 B, 99 C, 102; D6/13; 119/20; 272/3; 16/150, DIG. 13; 403/220, 223, 85; 182/163

[56] References Cited

U.S. PATENT DOCUMENTS

| | | | |
|---|---|---|---|
| 60,357 | 12/1866 | Gerard | 256/25 |
| 469,131 | 2/1892 | Freid | 256/25 |
| 2,011,528 | 8/1935 | Seay | 256/26 |
| 2,508,110 | 5/1950 | Hansen | 5/99 B |
| 2,526,129 | 10/1950 | Groesbeck et al. | 16/150 |
| 2,686,042 | 8/1954 | Hendricks et al. | 256/26 |
| 3,830,011 | 8/1974 | Ochrymowich | 403/220 X |

FOREIGN PATENT DOCUMENTS

| | | | |
|---|---|---|---|
| 434883 | 10/1967 | Switzerland | 403/220 |
| 1115182 | 5/1968 | United Kingdom | 16/150 |

*Primary Examiner*—Andrew V. Kundrat

*Attorney, Agent, or Firm*—Finnegan, Henderson, Farabow, Garrett & Dunner

[57] ABSTRACT

A foldable playpen formed by rigid panels, each panel comprising two horizontal bars connected by vertical bars. Adjacent panels are joined to each other by flexible deformable elements which are attached to the ends of the horizontal bars. The panels are each locked in position to form a rigid structure by means of cross members which are inserted between vertical bars of adjacent panels so as to span the angle formed between the adjacent panels.

11 Claims, 7 Drawing Figures

PLAYPEN

BACKGROUND OF THE INVENTION

The present invention relates to a foldable playpen.

It is known to produce such playpens having four panels articulated with each other, two opposite panels being themselves articulated to allow them to be folded in two.

These devices, which have been used for very many years, have numerous disadvantages. For example, their production is relatively complicated since twelve hinges have to be placed at very precise positions. But, in particular, each hinge constitutes a danger for the child who runs the risk of pinching his fingers. These devices have consequently disappeared from the market.

SUMMARY OF THE INVENTION

The present invention relates to a playpen affording the advantages of the former known devices without having any of their disadvantages.

According to the present invention there is provided a foldable playpen comprising: at least three rigid panels, each panel comprising an upper and a lower horizontal bar connected by a plurality of vertical bars; a flexible deformable element attached to each end of the horizontal bars connecting the upper and lower horizontal bars of one panel respectively with the upper and lower horizontal bars of an adjacent panel, and cross members each of which is provided for locking two adjacent panels in position with respect to each other when arranged to span an angle between the two adjacent panels and supported at each end by a vertical bar.

A preferred embodiment of this playpen is characterised by the fact that it is formed by four identical panels articulated with each other by deformable elements and when in use, held locked at 90° to each other by movable cross members.

The deformable elements constituting the articulations can be: flexible, hollow tubes which are slipped on to the ends of lower and upper bars of the panels, flexible solid cylinders introduced into the ends of the said bars, or flexible rectangular plates arranged vertically on edge and fixed to the ends of the said bars.

The accompanying drawings are given by way of example and to facilitate understanding of the invention.

DESCRIPTION OF THE PREFERRED EMBODIMENTS

Figure 1:
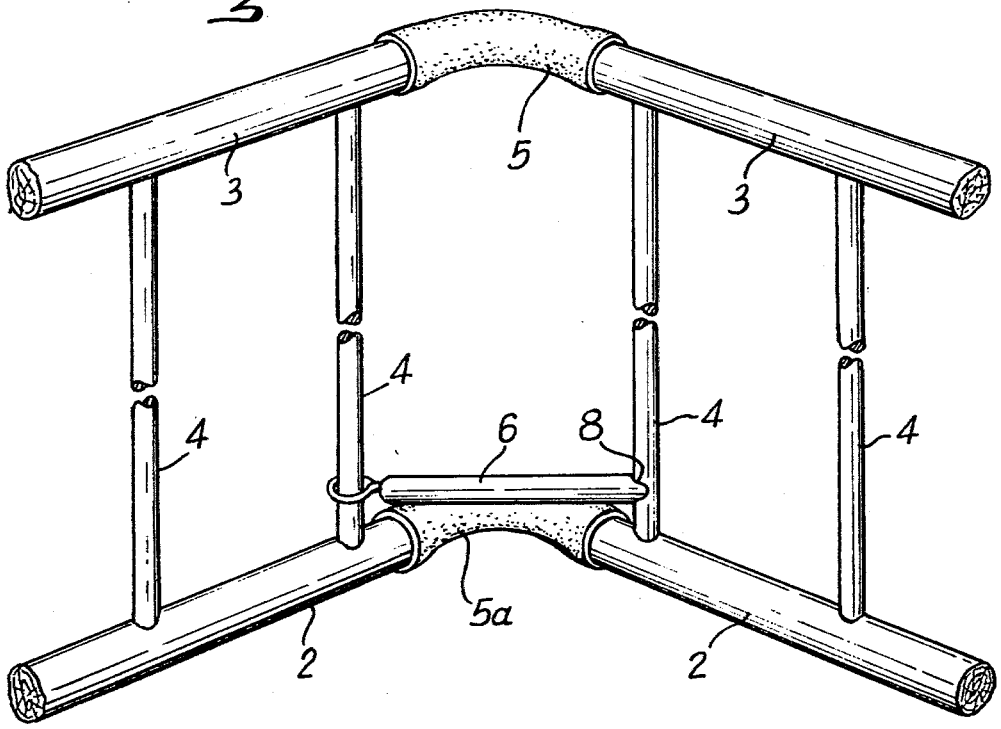
FIG. 1 shows a partial perspective view of a corner of a playpen according to the present invention.
Figure 2:
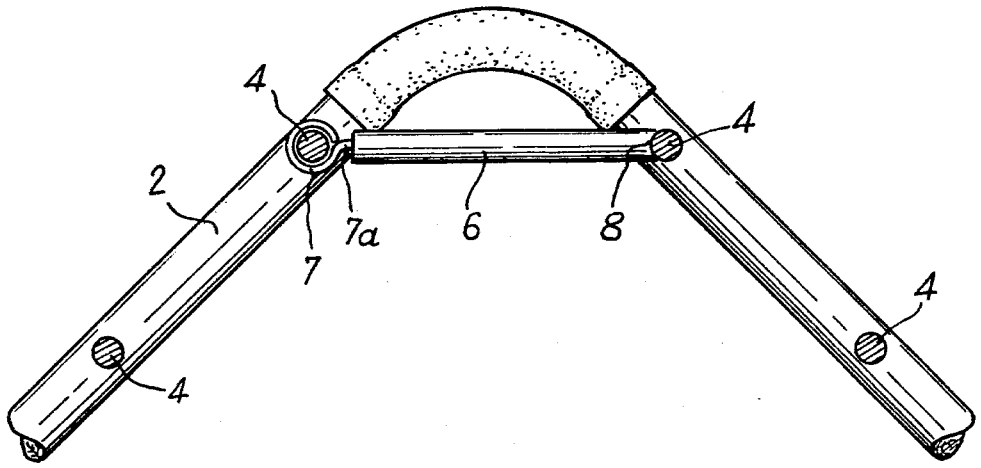
FIG. 2 shows a sectional plan view of the corner of the playpen as illustrated in FIG. 1.
Figure 3:
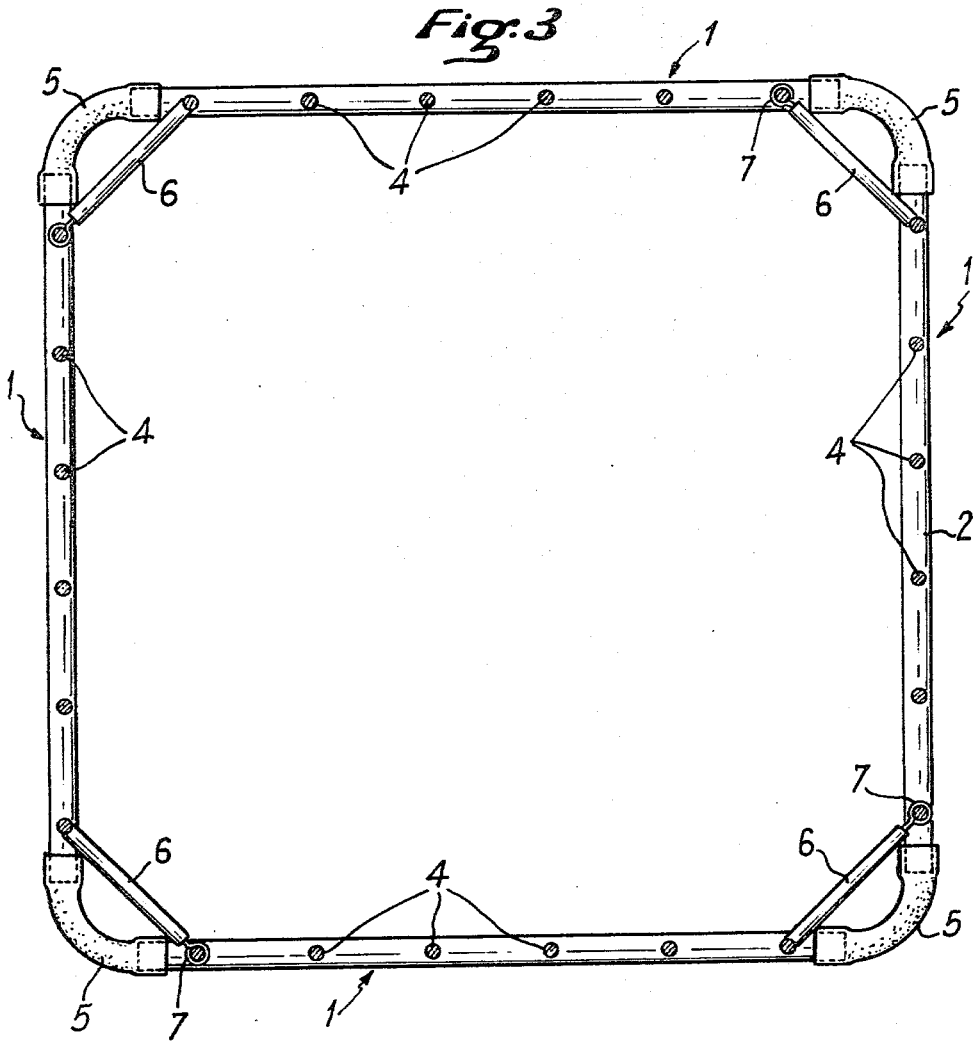
FIG. 3 shows a sectional plan view of a complete playpen.

With reference to FIGS. 1 to 3, it may be seen that, according to the present invention, the playpen is formed by four panels 1, each panel being constituted by a lower bar 2 and an upper bar 3, these two parallel horizontal bars being connected to each other by a plurality of small vertical bars 4.

These panels 1 are articulated with each other not by hinges but by deformable elements 5, 5*a*.

In the example illustrated in FIGS. 1 to 3, the bars 2 and 3 are round in cross section and the deformable elements 5, 5*a* are hollow tubes which are fitted on to the ends of the bars 2 and 3 and fixed by any suitable means for example by nails, hooks or glue.

The tubes 5, 5*a* may for example be made from rubber or plastic. In a preferred embodiment the tubes 5, 5*a* comprise a portion of reinforced plastic hosepipe. These tubes can be folded but still have a certain rigidity.

It is preferable to lock the four panels 1 at 90° to each other, and cross members such as 6 are used for this purpose, one cross member being arranged at each corner.

In the example illustrated in FIGS. 1 to 3, each cross member 6 is formed by a small bar 6 comprising at one of its ends a ring 7 which is slipped on to a bar 4, the ring 7 preferably being integral with a screw thread 7*a*. At its other end the bar 6 comprises a notch 8, whose curvature corresponds to that of the bars 4.

The cross member 6 is forcefully inserted between the two first bars 4 of two adjacent panels 1 thereby causing the entire assembly to be rigid.

The length of the cross member 6 is regulated by making it turn on itself in one direction or the other, that is, by screwing or unscrewing on the screw thread 7*a*. The extent to which the cross members 6 are locked between two bars 4, must be regulated.

This arrangement allows articles of round cross- section to be used for the bars 2 and 3, which is much more advantageous than the use of bars of square cross- section which were formerly used because of the positioning of the hinges. Furthermore, hinges are not employed, and this affords the double advantage of eliminating the risk of pinching, while at the same time considerably simplifying production since there are no longer any hinges to be installed. Production is also simpler and more economical since all the panels are identical and, finally, the locking produced imparts better stability to the assembly.

Figure 7:
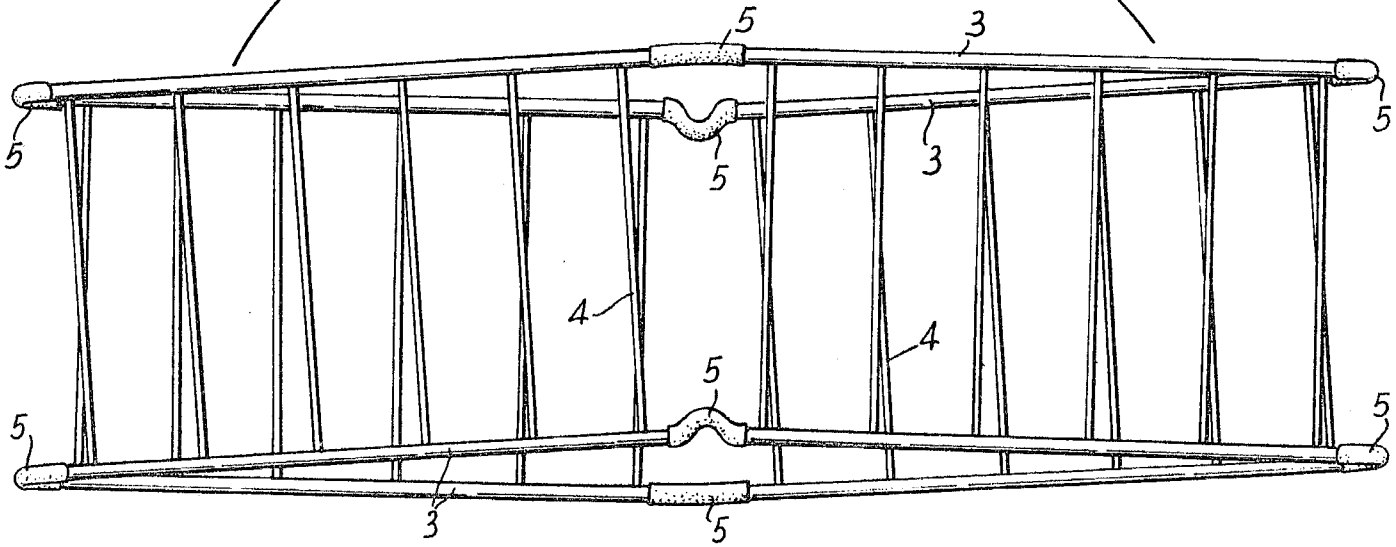
FIG. 7 shows a view illustrating the folding of the playpen.

With reference to FIG. 7, it may be seen that in order to fold up the playpen, the cross members 6 are released, then two of the corners of the playpen which are located on the same diagonal are brought together so as to flatten the playpen. These two flattened corners of the panels are then shifted vertically with respect to each other, as illustrated in FIG. 7, this being made possible by the fact that the articulation elements are flexible, thus permitting the flattened assembly to be folded in two in the middle.

In the example illustrated, it is preferable that the length of the cross members 6 is adjustable. However, another notch 8 may be provided for engaging a vertical bar instead of the ring 7, so as further to simplify production.

The bars 2, 3, 4 and the cross members 6 are preferably made of wood.

In the example illustrated in FIGS. 1 to 3, the articulations 5 are formed by hollow tubes each end portion of which is slipped on to one of the bars 2 and 3.

Figure 4:
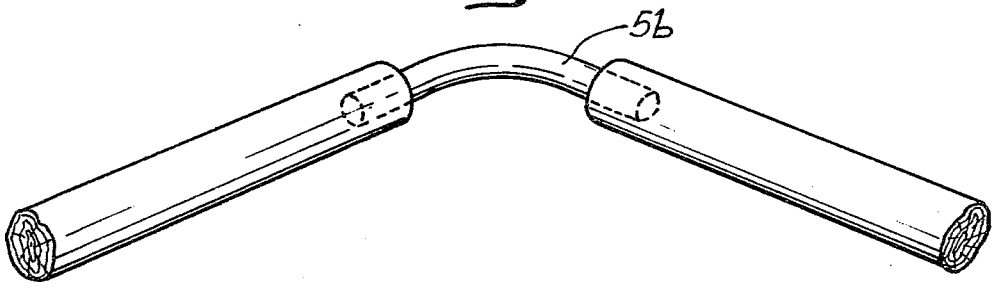
FIGS. 4 to 6 show three views illustrating three alternative embodiments.

However, solid cylinders such as 5*b*, (FIG. 4) can be used without departing from the scope of the present invention, the solid cylinders being introduced in the ends of the bars 2 and 3 which can thus be of round or square cross-section.

Figure 6:
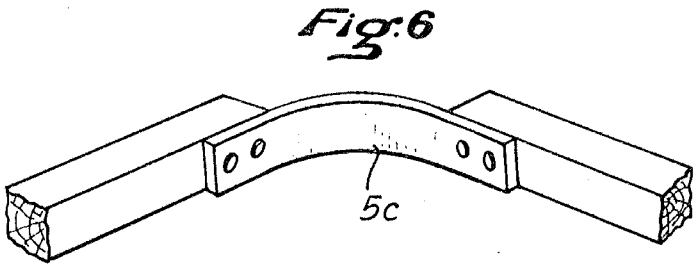
Figure 5:
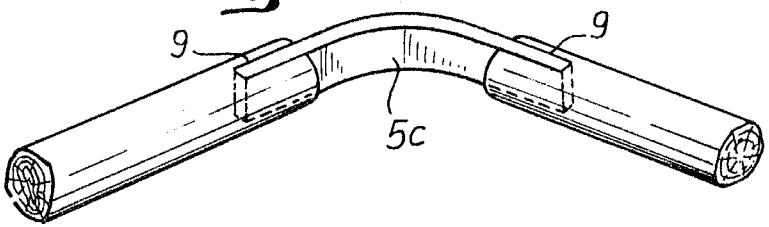

Rectangular flexible plates 5c which may either be placed in slots 9 made in the ends of the bars 2 and 3 (FIG. 5) or fixed on the sides of the said bars (FIG. 6), can also be used.

In the examples shown, the playpen is formed by four panels, but a polygonal playpen having more or less than four panels may be made in the same way and is within the scope of the present invention.

What is claimed is:

1. A folding playpen comprising: at least three rigid panels, each panel comprising an upper and a lower horizontal bar connected by a plurality of vertical bars; a flexible deformable element flexibly connecting the upper and lower horizontal bars of each panel with the upper and lower horizontal bars of adjacent panels, and cross members provided for locking each set of two adjacent panels in position with respect to each other when arranged to span an angle between the two adjacent panels and supported at each end by a vertical bar.

2. A folding playpen according to claim 1, in which each cross member has a notch at each end, each notch being provided for co-operatively engaging with a vertical bar.

3. A folding playpen according to claim 1, in which each cross member has at one end a notch provided to co- operatively engage with a vertical bar of one panel and at the other end a ring which is supported by a vertical bar of an adjacent panel.

4. A folding playpen according to claim 3, in which the ring is mounted on a screw thread in the end of the cross member in such a way that the effective length of the cross member can be increased or reduced by turning the cross member about the longitudinal axis of the cross member.

5. A folding playpen according to claim 1, in which the upper bar and lower bar of the panels are round in cross- section and each deformable element comprises a length of flexible tube slipped onto the ends of the said bars.

6. A folding playpen according to claim 1, in which each deformable element comprises a solid cylinder each end of which is inserted into the adjacent ends of two upper bars or two lower bars.

7. A folding playpen according to claim 1, in which each deformable element comprises a rectangular flexible plate each end portion of which is attached at the adjacent ends of two upper bars or two lower bars.

8. A folding playpen according to claim 7, in which each end portion of said plate is fixed in a slot formed in each of the adjacent ends of the two bars.

9. A folding playpen according to claim 7, in which each end portion of said plate is fixed to a side of the two bars.

10. A folding playpen according to claim 1, comprising four identical panels.

11. A folding playpen according to claim 10, wherein the playpen may be folded on itself, after having released the cross members, by bringing two opposite corners toward each other, thereby opening out the deformable elements of said two opposite corners, shifting the opened out deformable elements with respect to each other perpendicular to the longitudinal axis of the deformable members and folding the thereby flattened playpen in double about the previously opened out deformable elements.

* * * * *